United States Patent [19]

Scott et al.

[11] Patent Number: 5,070,947

[45] Date of Patent: Dec. 10, 1991

[54] AIR CUSHION MOUNT

[76] Inventors: Thomas M. Scott; David R. Scott, both of Rte. 1, Box 914, Petersburg, W. Va. 26847

[21] Appl. No.: 684,990

[22] Filed: Apr. 15, 1991

Related U.S. Application Data

[63] Continuation of Ser. No. 440,077, Nov. 22, 1989, abandoned.

[51] Int. Cl.[5] ..... E01C 19/38

[52] U.S. Cl. ..... 172/40; 172/776; 267/140.4; 267/140.2

[58] Field of Search ..... 172/25, 40, 762, 763, 172/776; 267/35, 140.1, 140.4, 140.2; 404/117; 37/DIG. 18

[56] References Cited

U.S. PATENT DOCUMENTS

| | | | |
|---|---|---|---|
| Re. 23,743 | 11/1953 | Lambert, Jr. et al. | 267/140.1 R |
| 3,778,177 | 12/1973 | Haker et al. | 404/117 |
| 3,868,145 | 2/1975 | Cobb et al. | 172/40 X |
| 3,966,344 | 6/1976 | Haker et al. | 404/117 |
| 4,278,368 | 7/1981 | Livesay | 172/40 X |

FOREIGN PATENT DOCUMENTS

| | | | |
|---|---|---|---|
| 866516 | 3/1971 | Canada | 404/117 |
| 168572 | 1/1986 | European Pat. Off. | 404/117 |
| 2149475 | 6/1985 | United Kingdom | 267/140.1 R |

*Primary Examiner*—Dennis L. Taylor
*Assistant Examiner*—Jeffrey L. Thompson
*Attorney, Agent, or Firm*—Walter G. Finch

[57] ABSTRACT

An air cushion mount system is provided between a backhoe system and a vibrator-compactor system for tampering material in a trench which is being filled. This air cushion mount consists of a tire having a wheel rim positioned on the inside rim of a steel pipe having an annular peripheral flange. A flange plate is coupled to the annular peripheral flange of the steel pipe so that the tire can be placed in operative condition or removed from operative condition. The elements of the backhoe are coupled to flanges fixed to the wheel hub. The cushion air mount is coupled by a plate member to the vibrator, and the latter in turn is affixed to a compactor for tampering material in a trench being filled with the same.

10 Claims, 2 Drawing Sheets

AIR CUSHION MOUNT

This patent application is a continuation of U.S. patent application Ser. No. 07/440,077 filed Nov. 22, 1989, now abandoned, for "Air Cushion Mount" invented by the applicants.

BACKGROUND AND SUMMARY OF THE INVENTION

This invention relates to vibration cushioning devices, and more particularly to an air cushion mount for mounting of vibration attachments to backhoe cranes and the like.

| The Prior Art | | |
|---|---|---|
| 3,108,519 | Domenighetti | 10/29/63 |
| 3,283,678 | Domenighetti | 11/08/66 |
| 3,323,428 | Domenighetti | 06/06/67 |
| 4,629,385 | Iris | 12/16/86 |

The patents to Domenighetti all teach the use of systems for transmission of motion of various types of vibrating members, together with the damping of vibrations creating in vibration tamping machines and equipment. The Iris patent, on the other hand, teaches a tire supplying apparatus to receive a tire to be vulcanized.

It is an object of this invention to provide an air cushion mount which will greatly advance the mounting of vibration attachments to backhoe cranes.

Another object of this invention is to adjust the stability of an air cushion mount by the amount of air pressure put in a tire system.

Still another object of this invention is to provide an inexpensive air cushion mount which will outlast and out perform conventional mounts known today.

And still a further object of this invention is to provide an air cushion mount which will apply pressure in any direction without the possibility of tearing and/or damaging the mount.

Still other objects of this invention are to provide air cushion mounts which are economical and efficient and reliable in operation, easy to install and maintain and of simple design and construction.

BRIEF DESCRIPTION OF THE DRAWINGS

These and other objects and attendant advantages of this invention will become more apparent and obvious from the accompanying specification and detailed attached drawings in which.

DESCRIPTION OF THE PREFERRED EMBODIMENTS

Figure 1:
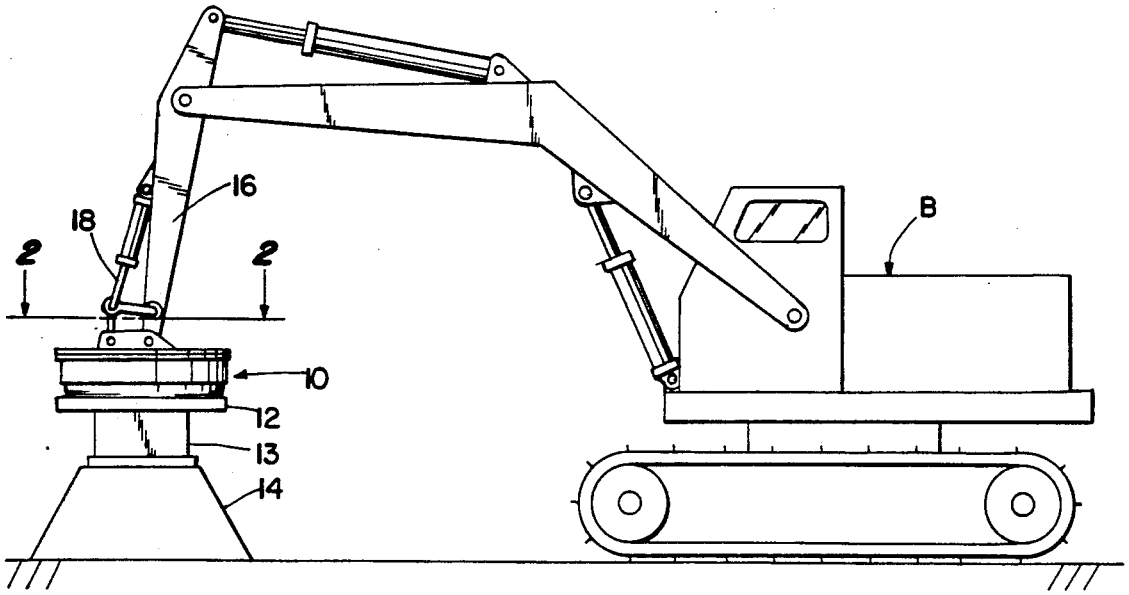
FIG. 1 is a side view of a backhoe showing an air cushion mount incorporating features of this invention.
Figure 2:
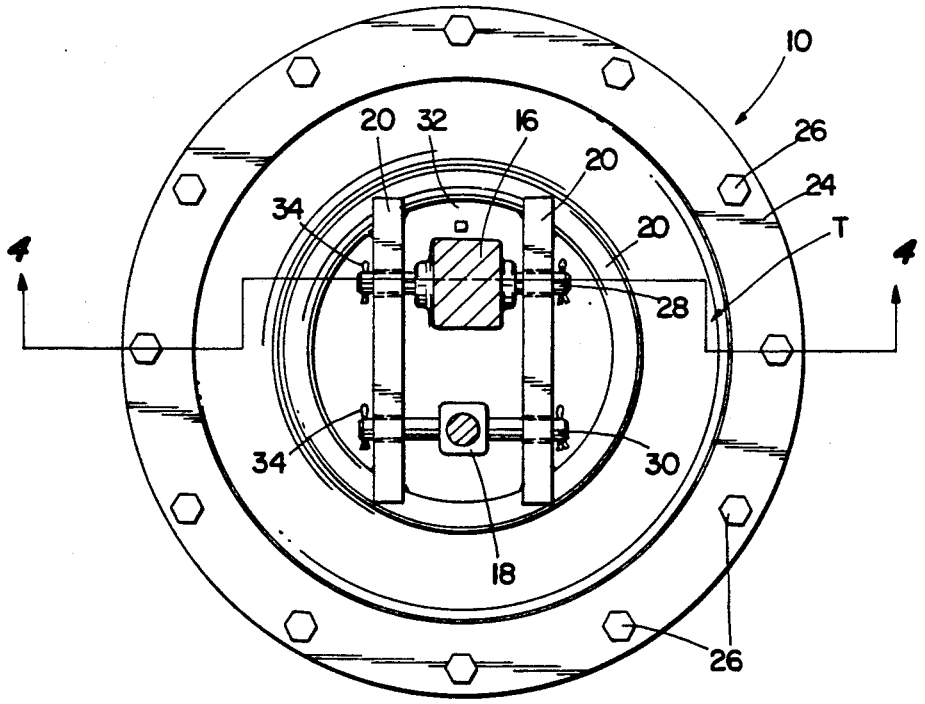
FIG. 2 is a cross section taken along line 2—2 of FIG. 1.

Referring now to FIGS. 1 and 2 of the drawings, there is shown a track type backhoe B having a crane arm linkage system 16 and 18 attached to an air cushion mount 10 incorporating features of this invention. The air cushion mount 10 is coupled to a vibrator 13 through a base member 12. The vibrator 13, in turn, is coupled to a back-filling trench compactor or bucket 14. This arrangement is used for compacting earth material back into trenches with one backhoe.

Figure 3:
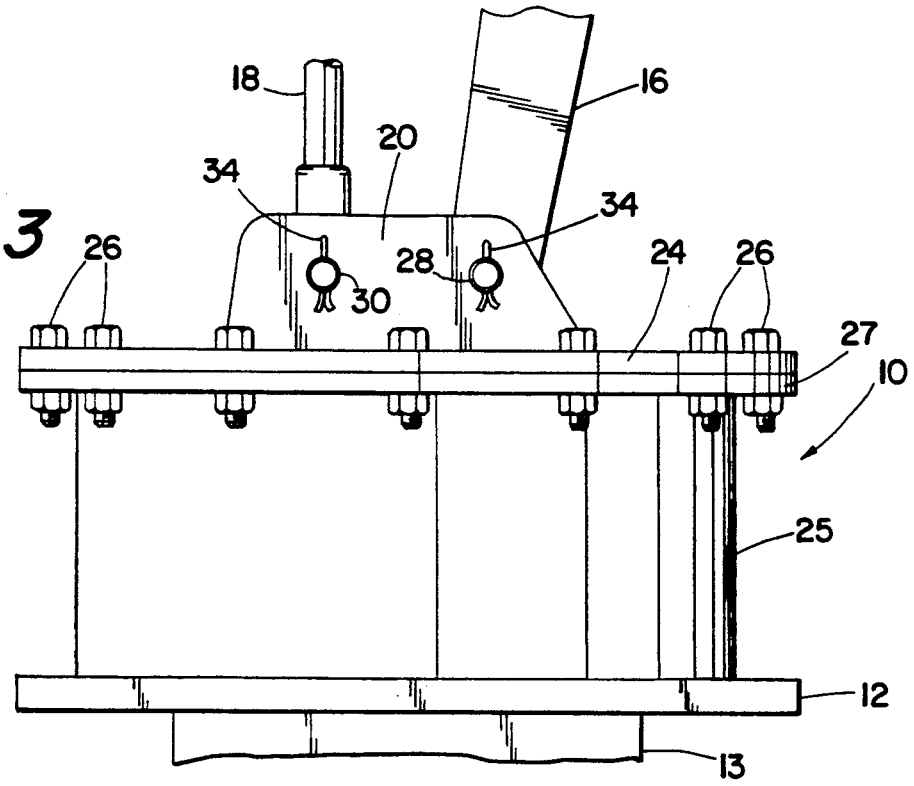
FIG. 3 is a side view of the air cushion mount of FIG. 1.
Figure 4:
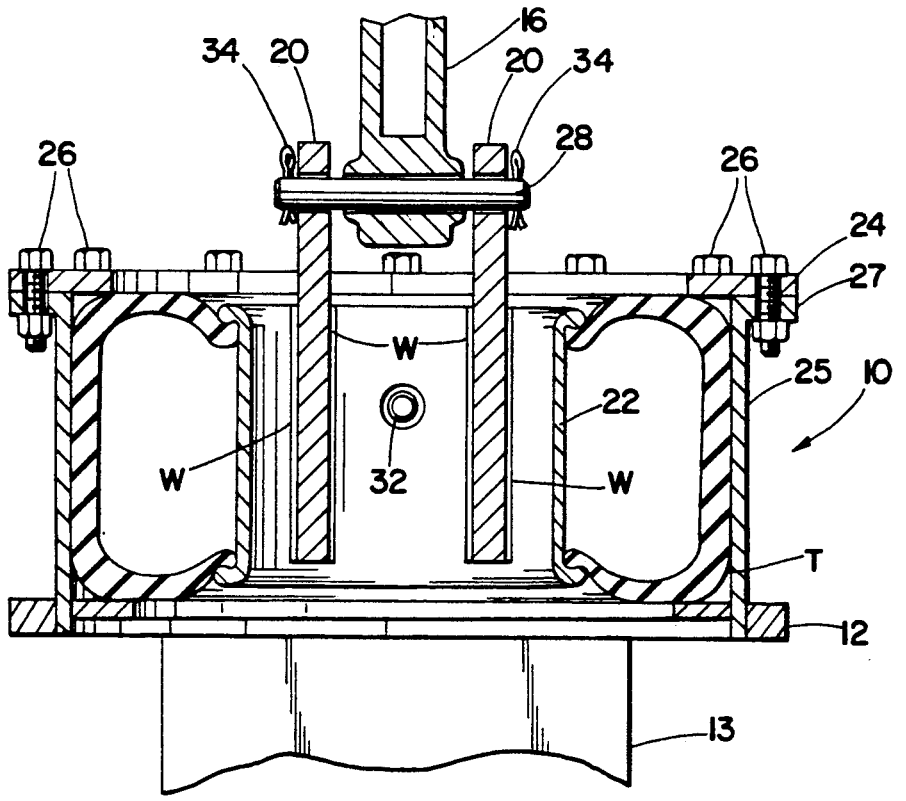
FIG. 4 is a cross section taken along line 4—4 of FIG. 2.

Referring now to FIGS. 2, 3 and 4, the air cushion mount 10 consists of a wheel W (see FIG. 4) and a tire T positioned inside of a steel pipe 25 having the same diameter as the outside of the tire T.

The steel pipe 25 is provided with a peripheral flange 27 on one side of the tire T.

A top flange peripheral support 24 is bolted by bolts 26 to the flange 27 at spaced points around the periphery of the flange 27. Such an arrangement makes it possible to allow removal of the tire T from the steel rim or pipe 25.

The attachment of the backhoe member 16 and hydraulic member 18 is made by welding and/or fixing spaced brackets 20 to the rim 22 of the wheel W and the provision of spaced pins 28 and 30 located between the spaced brackets 20. These pins 28 and 30 are kept in position by cotter pins 34 located at the opposite ends of the spaced pins 28 and 30.

The steel rim and/or pipe 25 is clamped around the outside of the tire T and the steel rim is welded to the vibrator-compactor system 13 and 14 by use of the base plate 12.

This air cushion mount 10 was based on a problem of making a mount strong enough to support a bucket 14 to backfill a trench, yet allow the vibrator 13 to vibrate without vibrating the backhoe system 16.

The air cushion mount system 10 as described greatly advances the mounting of vibrating attachments, such as vibrator 13 to backhoe cranes 16. Such a mount system 10 allows for adjusting the stability of the mount system 10 by varying the air pressure put in the tire T.

In addition to the above, the air cushion mount 10 is an economical mount that will outlast and out perform any conventional mount known of currently. Most rubber mounts designed and constructed at present will not allow for side to side pressure without tearing and/or damaging the rubber mounts. On the other hand, the air cushion mount 10 of the present invention makes it possible to apply pressure in any direction without the possibility of tearing and/or damaging the air cushion mount 10.

Obviously, many modifications and variations of the present invention are possible in light of the above teachings. It, is therefore, to be understood that within the scope of the appended claims, the invention may be practiced otherwise than as specifically described.

What is claimed is:

1. In combination, an air cushion mount system and a vibrating attachment, said air cushion mount system having an annular cylindrical rim means positioned horizontally on top of said vibrating attachment with its axial direction extending vertically, an inflatable annular tire means positioned on the inside of said annular cylindrical rim means, means for coupling said annular tire rim means and said inflatable annular tire means together so that said inflatable annular tire means cannot be moved from said annular cylindrical rim means during operation, said vibrating attachment operatively connected to an implement and being positioned vertically between said air cushion mount system and said implement, and means for coupling said air cushion mount system to an upwardly disposed carrying link arm or cable.

2. An air cushion mount system as recited in claim 1, wherein said annular cylindrical rim means includes a cylindrical pipe-shaped member positioned concentrically around of said inflatable annular tire means.

3. An air cushion mount system as recited in claim 1, wherein said inflatable annular tire means includes a tire-shaped member.

4. In combination, a cushion mounting arrangement for absorbing vibrations and a vibrating attachment, said mounting arrangement comprising an annular rim means positioned horizontally on top of said vibrating attachment with its axial direction extending vertically, a tire-shaped member having a hub, means for securing said tire-shaped member inside of said annular rim means, and means for attaching said mounting arrangement between a carrying member and said vibrating attachment.

5. A cushion mounting arrangement as recited in claim 4, and means for positioning said tire-shaped member horizontally between said carrying member and said vibrating attachment so that the vibrating motion is generally vertical and parallel to the axial direction of said hub of said tire-shaped member.

6. A cushion mounting attachment for absorbing vibrations as recited in claim 4, and means for positioning said tire-shaped member so that the up and down movement of said vibrating attachment is vertical and parallel to the axial direction of said hub and said annular rim means.

7. A cushion mounting attachment for absorbing vibrations as recited in claim 4, wherein said tire-shaped member is arranged so that when a downward force is placed against said vibrating attachment by the weight of an external weight source, the downward force of said external weight source is at a right angle to sidewalls of said tire-shaped member.

8. A cushion mounting arrangement for absorbing vibrations as recited in claim 4, said tire-shaped member comprising a tube having horizontal layers of rubber membrane filled with air pressure such that the vibrating motion generated by said vibrating attachment is at right angles to the horizontal layers of said rubber membrane.

9. A cushion mounting arrangement for absorbing vibrations as recited in claim 4, and additionally an earth tamping plate attachment attached to said vibrating attachment, with the vibrating motion being applied to said earth tamping plate attachment without vibrating said carrying member.

10. A cushion mounting arrangement for absorbing vibrations as recited in claim 4, and means for applying different amounts of air pressure to said tire-shaped member.

* * * * *